United States Patent [19]

Jividen et al.

[11] 4,087,316

[45] May 2, 1978

[54] PROCESS FOR OBTAINING SEED HULL COMMODITIES INCLUDING CELLULOSIC FIBERS AND XYLITOL

[75] Inventors: Gay M. Jividen, Raleigh, N.C.; Hou-Min Chang, Bellevue, Wash.; R. Heath Reeves; Chen-Loung Chen, both of Raleigh, N.C.

[73] Assignee: Cotton Incorporated, New York, N.Y.

[21] Appl. No.: 723,625

[22] Filed: Sep. 15, 1976

Related U.S. Application Data

[63] Continuation-in-part of Ser. No. 609,679, Sep. 2, 1975, abandoned.

[51] Int. Cl.[2] ..... D21C 9/08; D21C 5/00; D21C 3/02

[52] U.S. Cl. ..... 162/14; 162/55; 162/65; 162/95; 127/37

[58] Field of Search ..... 127/37; 8/139, 138; 162/14, 91, 95, 99, 65, 55; 260/635 C

[56] References Cited

U.S. PATENT DOCUMENTS

| | | | |
|---|---|---|---|
| 105,923 | 8/1870 | Duval et al. | 162/95 |
| 858,411 | 7/1907 | McFarland | 162/95 |
| 1,842,649 | 1/1932 | Bassett | 162/95 |
| 1,987,195 | 1/1935 | Kipper | 162/99 |
| 2,615,883 | 10/1952 | Sweeney et al. | 162/14 |
| 3,251,716 | 5/1966 | Porter | 127/37 |
| 3,558,725 | 1/1971 | Kohno et al. | 127/37 |
| 3,640,768 | 2/1972 | Eckemeyer | 162/14 |
| 4,008,285 | 2/1977 | Melaja | 127/37 |

FOREIGN PATENT DOCUMENTS

| | | | |
|---|---|---|---|
| 2,530,457 | 1/1976 | Germany. | |
| 49-93601 | 9/1974 | Japan | 162/65 |
| 543,862 | 3/1942 | United Kingdom | 8/139 |

OTHER PUBLICATIONS

Hata, et al ABIPC vol. 45, No. 10 (Apr. 1975) "Oxygen–Alkali Cooking of Crude Linters" Japan Tappi 29 No. 1 (Jan. 1975) Abstract #10658.

*Primary Examiner*—S. Leon Bashore
*Assistant Examiner*—Steve Alvo
*Attorney, Agent, or Firm*—Burns, Doane, Swecker & Mathis

[57] ABSTRACT

Cellulosic fibers are removed from seed hulls such as cottonseed hulls by a process including (a) in the absence of mechanical action sufficient to cause degradation of fiber properties, contacting the seed hulls which comprise both cellulosic fibers (linters and hull fibers) and non-fibrous hull components with an alkaline solution and an oxygen-containing gas until the cellulosic fibers are substantially free of the non-fibrous hull components, and (b) recovering the cellulosic fibers from the non-fibrous hull components so as to produce readily washable cellulosic fibers having substantially unimpaired mechanical properties. The cellulosic fibers may then be washed and separated according to known fiber fractionation procedures. The cellulosic fibers produced according to this improved process have substantially unimpaired mechanical properties and contain substantially no polyphenolic materials or extraneous color components. The process provides a more selective and complete removal of polyphenolic materials and extraneous color material requiring less alkali and resulting in higher carbohydrate yields than prior art processes. The process eliminates or significantly alleviates the noise and respiratory dangers of certain known mechanical delinting processes.

Other seed hull commodities may also be obtained. These other seed hull commodities include hull residue containing xylan which may be further treated to produce xylose and xylitol. Xylose is produced by hydrolyzing the xylan such as by dilute sulfuric acid treatment. Xylitol may be produced by catalytically hydrogenating xylose hydrolyzate solution and then crystallizing xylitol directly from the hydrogenated hydrolyzate solution.

16 Claims, 1 Drawing Figure

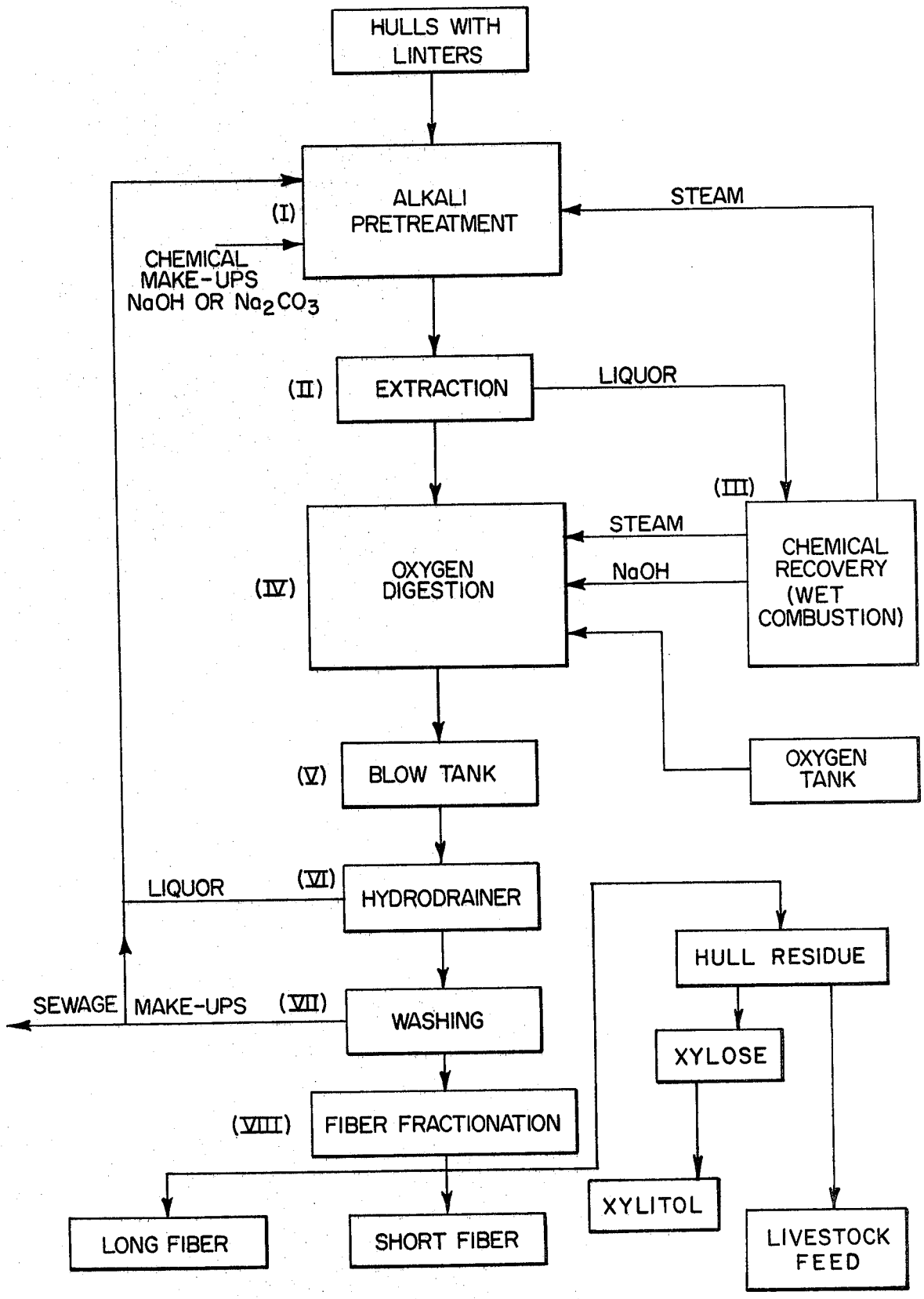
HULLS WITH LINTERS
ALKALI PRETREATMENT
(I)
CHEMICAL MAKE-UPS NaOH OR $Na_2CO_3$
STEAM
EXTRACTION
(II)
LIQUOR
(III)
CHEMICAL RECOVERY (WET COMBUSTION)
STEAM
NaOH
OXYGEN DIGESTION
(IV)
OXYGEN TANK
BLOW TANK
(V)
HYDRODRAINER
(VI)
LIQUOR
HULL RESIDUE
SEWAGE
MAKE-UPS
(VII)
WASHING
XYLOSE
FIBER FRACTIONATION
(VIII)
XYLITOL
LONG FIBER
SHORT FIBER
LIVESTOCK FEED

PROCESS FOR OBTAINING SEED HULL COMMODITIES INCLUDING CELLULOSIC FIBERS AND XYLITOL

CROSS-REFERENCE TO RELATED APPLICATION

This is a continuation-in-part of copending application Ser. No. 609,679, filed Sept. 2, 1975 and now abandoned.

BACKGROUND OF THE INVENTION

1. Field of the Invention

This invention relates in general to processes for obtaining cellulosic fibers from plant materials. More specifically, this invention relates to processes for removing cellulosic fibers from seed hulls such as cottonseed hulls. This invention also relates to the recovery or production of other hull commodities including xylan, xylose and xylitol.

1. Summary of the Prior Art

Seed hulls such as cottonseed hulls contain various cellulosic fibers either attached to or substantially embedded in the epidermal layer of the seed hull. The long fibers or hairs are called lint fibers or staple cotton. These long fleecy fibers or hairs are removed in cotton ginning operations and are widely used for spinning into cotton fabrics. The short fibers, not suitable for spinning, are called linters. These cotton linters, adhering to the hull of the cottonseed after ginning, are mature fibers, with increased secondary wall growth, and are just as pure a form of cellulose as staple fibers. In a cottonseed oil mill, the cottonseeds adhering linters are typically delinted so as to separate the linters from the seed hull. The delinted seeds are then decorticated or dehulled to recover the meat or kernel. Such delinting prior to dehulling has been found typically necessary so that the linters would not interfere with recovery of the meat or oil and contribute to losses in yield at the oil mill.

The linters thus obtained are useful in the manufacture of rayon, cellulosic plastics, photographic film, explosives, lacquers, cellulosic derivatives, cotton-felt, paper products, upholstery, padding, and mattress materials. For all uses the linters receive substantial secondary processing due to trash and dirt content, which may amount to as much as 25 percent of the linter material from the oil mill. Typical processing steps for linters include wet and dry mechanical cleaning, pressure digestion in caustic soda, bleaching, washing, centrifugal cleaning, and drying.

Seed hulls also contain "hull fibers" — i.e., cellulosic fibers which are substantially embedded within the seed hull.

Heretofore, mechanical delinting operations typically removed about 80 percent of the linters adhering to the cottonseed hull. Mechanical delinting operations are not successful in removing the hull fibers from seed hulls.

Various methods have been suggested for removing cellulosic fibers from cottonseed hulls. These methods include mechanical, chemical (see, e.g., U.S. Pat. Nos. 105,923 and 159,455), and combined chemical/mechanical (see, e.g., U.S. Pat. Nos. 357,089, 1,295,078 and 1,987,195) methods.

In a typical mechanical operation, cottonseed hulls, for example, which have been separated from the meal or kernel are passed through an attrition mill which comprises a gin with saw-teeth that cuts the linters close to the seed or alternatively cuts the linters from the hulls which are incidentally fragmented and ground up. Although such processes are advantageous in that they tend to separate the linters from the seed hull components, they also have several disadvantages. For example, such mechanical delinting operations tend to produce a large amount of noise and dust resulting in potentially hazardous working conditions. Also, the linters produced in this operation tend to be shortened by the cutting action (the "foot" and "shank" of the fiber remain embedded in the hull) and are thus not useful in applications which require longer fibers.

Mechanical treatment of the cottonseed hull also results in attack upon the fiber. For example, mechanical grinding operations tend to break down the cellulosic fibers into a mesh of cellulose molecules. Also, in a saw-type mechanical delinting operation, cutting action in the delinting machine tends to shorten all the fibers, shear off hull epidermal material, and the linters recovered require extensive processing (such as washing, centrifugal cleaning and drying) before being suitable for any end use.

A typical chemical method for removing cottonseed linters from cottonseed hulls is disclosed in U.S. Pat. No. 159,455 (Rock). This patent describes a combined steam/wet alkali solution process for separating the fiber (which was not previously removed by the ginning operation) from cottonseed hulls. However, the use of alkaline solutions, either with or without the presence of steam, has several disadvantages. For example, sufficiently weak alkaline solutions do not completely dissolve the binding components in the seed hulls so as to facilitate separation of the hull residues from the fibrous component. On the other hand, alkali which is strong enough to dissolve the non-fibrous hull components at high temperature is also strong enough to damage the linters present in the cottonseed hulls, thus making them unsuitable or only poorly suited for certain applications, such as papermaking, upholstery, padding and mattress manufacture, or other textile-like application. Furthermore, strong alkali can mercerize the fibers, making them unsuitable or only poorly suited for some chemical processing applications. Besides being advantageous from a product standpoint, the use of such large amounts of alkali (i.e., that which is sufficient to dissolve the non-fibrous hull components) is economically disadvantageous from a process standpoint.

Furthermore, prior art chemical delinting processes result in a relatively low yield of cellulosic fibers and the cellulosic fibers produced are not readily washable because of high residual alkali concentration at the end of the chemical treatment stage.

Combined chemical/mechanical delinting processes have many of the disadvantages of both the chemical and mechanical delinting processes discussed above, as well as the additional disadvantage of chemically loosened fibers forming rope-like masses of significant strength, thus contributing to clogging or otherwise interferring with the mechanical beater bars or knives. Furthermore, all of the above processes result in a low yield of cellulosic fibers and the cellulosic fibers produced are not readily washable.

Other methods for treating seed hulls by chemical or combined chemical/mechanical processes are also known. For example, the non-fibrous hull components (such as polyphenolic materials) of seed hulls may be dissolved by treating the hulls in a typical soda digestion process. However, such processes suffer from the disadvantages that (1) the non-fibrous hull materials are not completely removed, (2) large amounts of alkali must be used, and (3) the large amounts of alkali required result in the fibers being difficult to wash.

The residual cottonseed hull consists primarily of cellulose, lignin, polyphenols, hemicellulose and some minor components. The hemicellulose fraction is primarily xylan which is of commercial interest for the production of various conversion products. It has been shown in the past that the xylan in cottonseed hulls can be isolated for conversion into particularly furfural, xylose, and xylitol. Prior art (U.S. Pat. Nos. 3,565,687 and 3,558,725) teaches that the xylan may be converted sequentially to xylose and xylitol without first isolating the xylan. These processes involve treating the cottonseed hulls with dilute alkali solution to remove some color-forming impurities, and then hydrolyzing the xylan-containing hull with dilute sulfuric acid to produce a xylose solution. This xylose solution, however, still contains color-forming impurities which must be removed using complex and costly ion-exchange treatments.

Accordingly, the search has continued for improved processes for obtaining cellulosic fibers from seed hulls, as well as for obtaining other seed hull commodities including xylose and xylitol. The present invention was developed as a result of this search.

OBJECTS AND SUMMARY OF THE INVENTION

Accordingly, a general object of the present invention is to avoid or substantially alleviate the above problems of the prior art.

A more specific object of the present invention is to provide an economical process for removing cellulosic fibers from seed hulls.

It is a further object of the present invention to provide a process for removing cellulosic fibers from seed hulls in a manner such that a high yield of fibrous material results.

Yet another object of the present invention is to provide a substantially dustless, low-noise level process for removing cellulosic fibers from seed hulls.

A further object of the present invention is to provide a process for removing cellulosic fibers from seed hulls without substantially shortening the fibers.

Still another object of the present invention is to provide readily washable cellulosic fibers having substantially unimpaired mechanical properties readily usable without further cleaning and bleaching processes for use in the manufacture of rayon, cellulosic plastics, photographic film, explosives, lacquers, cellulose derivatives, cotton-felt, paper products, upholstery, padding, and mattress material.

Yet another object of the present invention is to provide for the recovery or production of seed hull commodities including xylan, xylose and xylitol.

Another more particular object of the present invention is to isolate xylose or xylitol in a practical and commercial manner from the xylan contained in cottonseed hulls in substantially higher purity and without recourse to costly ion exchange treatments.

Other objects and advantages of the present invention will become apparent from the following summary and description of the preferred embodiments of the present invention.

In one aspect, the present invention provides an improved process for removing cellulosic fibers from seed hulls. This process comprises (a) in the absence of mechanical action sufficient to cause degradation of fiber properties, contacting the seed hulls which comprise both cellulosic fibers and non-fibrous hull components with an alkaline solution and oxygen-containing gas until the cellulosic fibers are substantially free of the non-fibrous hull components, and (b) recovering free cellulosic fibers from the non-fibrous hull components so as to produce readily washable cellulosic fibers having substantially unimpaired mechanical properties.

In another aspect, the present invention comprises a pretreatment step wherein the seed hulls prior to the primary alkali solution/oxygen gas contact step may be contacted with an alkaline solution weaker than that employed in the primary alkaline solution/oxygen gas contact step. This "pretreatment" step substantially reduces the consumption of alkaline solution and oxygen gas in the subsequent primary alkaline solution-/oxygen gas contact step. This pretreatment step also softens and swells the hulls for the subsequent primary treatment, and further removes lignins, polyphenolics and colorants from the seed hull material.

In yet another aspect of the present invention, xylose is produced by a process which includes (a) providing a xylan-containing seed hull residue essentially free of coloring substances and essentially free of linters and other hull fibers; (b) hydrolyzing the xylan in the hull residue to convert xylan to xylose and thereby immediately producing a xylose hydrolyzate solution essentially free of coloring substances; and (c) recovering xylose as a product.

In yet another aspect, the above process further comprises the production of xylitol by the additional steps of (d) neutralizing the xylose hydrolyzate solution; (e) catalytically hydrogenating the neutralized xylose hydrolyzate solution to convert xylose to xylitol; and (f) recovering xylitol as a product.

In another aspect of the present invention, a process is provided which includes (a) contacting the seed hulls with an alkaline solution and oxygen gas at a concentration and temperature and for a time sufficient to remove polyphenolic materials and coloring substances but not appreciable xylan from the seed hulls and to soften the seed hulls and render fibers substantially free from the hulls and insufficient to remove appreciable xylan from the hulls; (b) separating said softened cottonseed hulls and fibers so as to produce (1) essentially clean cellulosic fibers and (2) hull residue comprising xylan, the hull residue being essentially free of polyphenolic materials and coloring substances and essentially free of hull fibers; and (c) hydrolyzing the xylan-containing hull residue to convert xylan to xylose and produce a xylose hydrolyzate solution.

In yet another aspect of the present invention, the present invention provides a process for obtaining xylose and readily usable cellulosic fibers from seed hulls, which process comprises: (a) pretreating the seed hulls with alkaline solution at a concentration and temperature and for a time sufficient to remove polyphenolic materials and coloring substances but not appreciable xylan from the seed hulls and to soften the seed hulls; (b) separating the softened cottonseed hulls from the alkaline solution; (c) contacting the softened cottonseed hulls with an oxygen gas-saturated alkaline solution at a concentration and temperature and for a time sufficient to soften further the seed hulls and render fibers readily separable from the hulls and insufficient to remove appreciable xylan from the hulls; (d) separating said softened cottonseed hulls and fibers so as to produce (1) essentially clean cellulosic fibers and (2) hull residue comprising xylan, the hull residue being essentially free of polyphenolic materials and coloring substances and essentially free of hull fibers; and (e) hydrolyzing the xylan-containing hull residue to convert substantially all of the xylan to xylose and produce a xylose hydrolyzate solution.

In yet another aspect, the above process further comprises (f) separating the xylose hydrolyzate solution from remaining hull residue; (g) neutralizing the xylose hydrolyzate solution; (h) catalytically hydrogenating the xylose hydrolyzate solution to convert xylose to xylitol; and (i) crystallizing xylitol crystals directly from the hydrogenated hydrolyzate solution.

In still another aspect, the present invention provides cellulosic fibers, xylose, xylitol and other seed hull commodities produced according to the above described processes.

The essence of the present invention includes the discovery that cellulosic fibers, including both linters and hull fibers, may be economically and efficiently removed from seed hulls in high yield by contacting the seed hulls with a combination of an alkaline solution and oxygen gas. The alkaline solution and oxygen gas dissolve the binding agent which hold the cellulosic fibers of the seed hull. The use of an alkaline solution in combination with oxygen gas permits the use of less concentrated alkaline solutions than if an alkaline solution alone is employed. The use of such less concentrated alkaline solutions results in substantially no degradation of the cellulosic fibers and allows the cellulosic fibers to be readily washed to an essentially clean state. Also, the combination of such less concentrated alkaline solution and oxygen gas removes and/or bleaches and/or oxidizes color-forming substances which if not removed would interfere with subsequent treatment and/or use of the hull and fiber material. Further, it has been found that when seed hulls such as cottonseed hulls are so treated, that the xylan in the seed hull does not pass into solution until virtually all of the polyphenolics and other color-forming material has been dissolved and, further, that such treatment of the hulls with oxygen and alkali effects preferential solubility of the lignin and remaining polyphenolics contained in the seed hull so that xylan and its conversion products xylose and xylitol may be recovered in high purity without recourse to complex and costly ion-exchange treatments.

BRIEF DESCRIPTION OF THE DRAWING

The Drawing represents a schematic diagram of a preferred embodiment of a process of the present invention.

DESCRIPTION OF PREFERRED EMBODIMENTS

As indicated hereinabove, the present process comprises a method for removing cellulosic fibers from seed hulls so as to produce readily washable cellulosic fibers having substantially unimpaired mechanical properties.

Seed hulls which may be used as the raw material in the present invention are those containing a substantial amount of cellulosic fibers in the seed hulls. Such seed hulls include cottonseed hulls, coconut husks, kapok seed hulls, rice hulls, sun flower seed hulls, and mixtures thereof. Cottonseed hulls which have been ginned, i.e., substantially all of the staple cotton fibers have been removed from the hull, are preferred starting materials in the present invention because such hulls are readily available in large quantities and the available cellulosic fiber comprises a substantial weight percent of the whole seed hull.

Cottonseed hulls comprise cellulosic fibers and non-fibrous hull components. The cellulosic fibers comprise the comparatively long (i.e., from about 5 to about 15 millimeters) linters, and the comparatively short (i.e., from about 1.5 to about 5 millimeters) hull fibers which are embedded in the hull itself. Certain decorticated cottonseed hulls heretofore available from cottonseed oil mills contain substantially shortened linters which have been "double cut". "Double cut" hulls typically contain fibers which are virtually all less than about 5 millimeters. While such "double cut" materials may be used in the present invention, "once cut" or "single cut" is preferably used and uncut material is most preferred in that significantly longer fibers may be recovered. The non-fibrous hull components comprise all of the components of the seed hulls except the cellulosic fibers and include binding agents (mainly polyphenols and lignin), glucan, and xylan.

An essential step of the present invention comprises contacting the seed hulls with an alkaline solution of an oxygen-containing gas so as to dissolve the binding agents and separate the cellulosic fibers from the non-fibrous hull components.

The alkaline solution which may be used in the process of the present invention comprises a basic or alkali compound and a solvent for that basic compound. The basic compound employed may be any base that is readily soluble in the solvent and which will react to dissolve the binding agents of the seed hulls. Such bases include hydroxides, bicarbonates and carbonates of ammonia and the alkali and alkaline earth metals. Mixtures of two or more bases may also be used.

Typical examples of such bases include sodium hydroxide, potassium hydroxide, magnesium hydroxide, sodium bicarbonate, potassium bicarbonate, ammonium bicarbonate, sodium carbonate, potassium carbonate, magnesium carbonate, ammonium carbonate, and ammonium hydroxide.

The hydroxides, bicarbonates, and carbonates of alkali metals are preferred based. Sodium hydroxide and sodium carbonate are particularly preferred bases.

The solvent used in the process of the present invention may be any solvent, whether organic or inorganic, which will dissolve the base and not interfere with the solubilizing of the binding agents of the seed hulls. Water is a particularly preferred solvent.

The relative amounts of base and solvent used depend upon several factors such as the reaction temperature and reaction time and also upon the amount of oxygen gas that is injected into the system. However, the amount of base used in the present process may be generally from about 1 to about 6, typically from about 1.5 to about 4, and preferably from about 2 to about 3% by weight and the amount of solvent may be correspondingly generally from about 94 to about 99, typically from about 96 to about 98.5, and preferably from about 97 to about 98% by weight based upon the total weight of the alkaline solution.

The amount of base relative to the amount of seed hulls which are to be treated also depends upon the reaction temperature and time as well as the amount of oxygen gas injected into the system. However, in the present process, there may be employed generally from about 2 to about 25, typically from about 8 to about 20, and preferably from about 12 to about 18% by weight base (calculated as sodium hydroxide and based upon the oven-dry weight of the seed hulls) and correspondingly generally from about 75 to about 98, typically from about 80 to about 92, and preferably from about 82 to about 88% by weight seed hulls (oven dry weight).

For purposes of this specification, the amount of base is always calculated as sodium hydroxide although other bases may be used as indicated hereinabove.

When an amount of base less than about 2% by weight based upon the oven-dry weight of the seed hulls is employed, it has been found that the reaction time and/or temperature must be so high that substantial degradation of the cellulosic fibers takes place. When an amount of base in excess of about 25% by weight based upon the oven-dry weight of the seed hulls is employed, it has been found that substantial fiber degradation takes place, the process is more costly, and the fibers are not readily washable due to the presence of excess base. Further, such higher amounts of base would undesirably tend to prematurely extract xylan into solution with the polyphenolics and other coloring substances.

The term "oxygen-containing gas" in the present specification is intended to include oxygen gas, the allotropic forms of oxygen such as ozone, and oxygen-containing gas mixtures such as air and compressed air. The term "oxygen gas" is used to indicate substantially pure oxygen in the gaseous state with only trace amounts of other gaseous components. Of course, the oxygen gas could be in whole or in part generated in situ. For example, peroxides such as hydrogen peroxide could be added to the alkaline solution, and these peroxides may then decompose to yield oxygen gas in solution.

As the concentration of oxygen gas in the oxygen-containing gas mixture decreases, then either the amount of the gas mixture used must be increased or the temperature of the reaction must be raised. If the reaction temperature must be raised, the increased temperature tends to degrade the cellulosic fibers as discussed hereinbelow. On the other hand, if the amount of the gas must be increased such as by increasing the pressure of the gas, more expensive reaction equipment must be used. However, other than this practical disadvantage, the product obtained using the gaseous mixture is similar to that obtained when substantially pure oxygen gas alone is employed.

By "fiber degradation" as used specifically in the above paragraph and in the present specification generally is meant that the cellulosic fibers are weakened, through mechanical and/or chemical action, so as to be easily fragmented. Thus, such degraded fibers would not be useful in applications such as paper making. Conversely, "fibers having substantially unimpaired mechanical properties" are fibers which have not been so degraded.

The amount of oxygen gas used will vary depending upon the reaction time and temperature as well as the amount of base used.

However, it has been found that particularly efficacious results are achieved when the alkaline solution is substantially saturated with oxygen gas.

The alkaline solution may be kept substantially saturated with oxygen gas by either (1) injecting the oxygen-containing gas above the liquid level of the solution while simultaneously agitating the liquid, (2) injecting the oxygen-containing gas below the liquid level of the solution, or (3) injecting the oxygen-containing gas through a conduit extending into the solution.

The alkaline solution is preferably saturated with oxygen gas by maintaining a blanket of oxygen gas above the level of the agitated liquid in the reactor.

The pressure of oxygen gas should be high enough so as to maintain the reaction solution substantially saturated with oxygen gas. Thus, it has been found that oxygen gas pressure of generally from about 50 to about 300, typically from about 90 to about 200, and preferably from about 120 to about 150 psi may be used in the process of the present invention. When oxygen-containing gases rather than substantially pure oxygen gas are used, proportionately higher pressures must be employed as discussed hereinabove.

If the pressure of oxygen gas is less than 50 psi then a higher temperature and/or higher alkali charge must be used to dissolve the non-fibrous portions of the seed hulls than is necessary when sufficient oxygen gas pressure is employed. However, at temperatures and/or alkali charge high enough to dissolve the non-fibrous portions of the seed hulls, fiber degradation occurs so that the resulting product has a strength no greater than that resulting from certain mechanical delinting processes. Also, premature xylan extraction may take place.

Furthermore, the use of oxygen gas alone (i.e., without base) will not dissolve the binding agents of the seed hulls.

The reaction temperature, pressure, and time are all interrelated and also depend upon the concentration of base and amount of oxygen gas used. The process may be conducted at temperatures of generally from about 50° to about 200° C, typically from about 90° to about 150° C, and preferably from about 110° to about 130° C. Temperatures substantially below about 50° may result in incomplete reaction whereas temperatures substantially in excess of about 200° C may result in fiber degradation.

As indicated hereinabove, the essential step of the present invention is typically carried out at superatmospheric pressures because of the necessity of using oxygen gas. The other steps of the present process may, however, be conducted at any pressure, atmospheric, superatmospheric, or subatmospheric, although atmospheric pressures are preferred.

The reaction rate is dependent upon the amount of base, amount of solvent, and the amount of seed hulls as well as the amount of oxygen gas used. However, the reaction time may be generally from about 10 to about 300, typically from about 30 to about 120, and preferably from about 45 to about 75 minutes. Reaction times less than about 10 minutes are typically not sufficient to dissolve a substantial portion of the non-fibrous components of the seed hulls whereas reaction times in excess of about 300 minutes tend to degrade the cellulosic fibers.

The present process is preferably carried out in the presence of steam. The steam may be used as a source of heat. The heat is necessary to keep the reaction temperature within the ranges described above. Of course, any other source of heat, such as an external heater, may alternatively be used.

The primary alkali/oxygen treatment step is preferably accompanied by agitation in order to ensure a more complete and intimate contact of the seed hulls, alkaline solution and oxygen gas. However, a non-agitated reactor may also be used.

The present process may be carried out in a batch, continuous, or semi-continuous manner.

As indicated hereinabove, the seed hulls may be preferably pretreated with a weaker alkaline solution than that used in the primary alkali/oxygen gas contact step. This "pretreatment" with weak alkaline solution substantially removes polyphenolic materials such as lignins and tannins, as well as extraneous components such as waxes, resins, oils, and fats. Thus, this pretreatment substantially reduces the consumption of alkali and oxygen gas in the subsequent primary alkali/oxygen gas treatment. Also, the pretreatment allows lower concentrations of alkali and/or oxygen gas to be used in the subsequent treatment step, thus ensuring that no significant or appreciable amounts of xylan will be prematurely extracted from the hull material. The term "appreciable" is used herein to indicate that the amount of prematurely extracted xylan which can be economically tolerated in a specific operation. Typically, such prematurely extracted xylan will amount to less than about 5% of hull weight on a dry basis. The pretreatment step also softens and swells the hulls for the subsequent primary treatment. The source of heat in the pretreatment step may be steam as discussed hereinabove with respect to the primary treatment step.

When such a "pretreatment step" is employed, a generally weaker alkaline solution and generally lower temperatures may be used than those alkali concentrations and temperatures used in the subsequent primary alkali/oxygen gas treatment step. For example, in the pretreatment step, there may be employed generally from about 0.1 to about 2, typically from about 0.3 to about 1.5, and preferably from about 0.4 to about 1% by weight base and correspondingly generally from about 98 to about 99.9, typically from about 98.5 to about 99.7, and preferably from about 99 to about 99.6% by weight solvent based upon the total weight of the alkaline solution.

Also, smaller amounts of base relative to the amount of seed hulls which are to be treated are needed in the pretreatment step. Thus, there may be employed generally from about 0.5 to about 10, typically from about 1 to about 8, and preferably from about 2 to about 6% by weight base (calculated as sodium hydroxide and based upon the oven-dry weight of the seed hulls) and correspondingly generally from about 90 to about 99.5, typically from about 92 to about 99, and preferably from about 94 to about 98% by weight seed hulls (over dry weight).

Instead of using a fresh dilute alkaline solution in the pretreatment step, the waste liquor recovered from the primary alkali/oxygen gas treatment step may be employed. The use of the waste liquor in this pretreatment step is preferred since it (1) reduces the total amount of alkali needed, (2) increases the solid content, and (3) decreases the volume of the waste liquor which may be treated for chemical and heat recovery.

The time employed for the reaction in the pretreatment step may be generally from about 10 to about 120, typically from about 30 to about 90, and preferably from about 50 to about 70 minutes.

The temperature employed in this pretreatment step is comparatively lower than that used in the primary alkali/oxygen gas treatment step. Thus, the pretreatment step reaction temperature may be generally from about 40° to about 140°, typically from about 60° to about 120°, and preferably from about 80° to about 100° C.

Temperatures in excess of about 100° C may be used but require pressurized equipment. Temperatures below about 40° C are less efficient in solubilizing the polyphenolic materials and thus require higher alkali charges.

After the pretreatment step, the free liquor and dissolved polyphenolic substances produced in this step may be separated from the solid material and may be recycled for reuse and/or recovered for alkali regeneration.

The solid material is then subjected to the primary alkali/oxygen gas treatment step as described above. This primary treatment step dissolves substantially all of the remaining polyphenolic substances and all extraneous color components.

The dissolved materials and free cellulosic fibers may be next preferably sent to a blow tank wherein the excess pressure is relieved and wherein heat may be recovered from the vapors by known heat exchanger means. The blowing step uses the pressure which has built up in the reactor to discharge the contents to a receiving vessel. The blowing step also tends to break up the remaining hull components and dissociate them from the fibrous components.

The dissolved materials and solid materials may be next sent to a separator where the liquid material (dissolved polyphenolics, spent liquor, extraneous color components and unused alkali) are drained or filtered from the solid material by known methods. The liquid material resulting from this step may be recovered either together with the liquid material resulting from the pretreatment stage or separately in order to regenerate the alkali by known methods. Alternatively, the spent liquor resulting from the primary alkali/oxygen gas treatment step preferably may be used as the pretreatment step liquor so that (1) the unused alkali remaining after the primary alkali/oxygen gas treatment step may be more efficiently utilized, (2) the total amount of fresh alkali added to the system may be minimized, and (3) the volume of spent alkali for chemical recovery and heat generation may be minimized.

The solid material may be removed from the separator and then washed according to known methods. The washed cellulosic fibers may then be separated from the hull residues mechanically by various fiber fractionation devices known to those skilled in this art.

The solid products may be divided into long (i.e., generally from about 5 to about 15, preferably from about 6 to about 10 millimeters) fibers or linters, short (i.e., generally from about 1.5 to about 5, preferably from about 2 to about 4 millimeters) hull fibers, and the hull residue components which are recovered essentially free of polyphenolic and color substances and consist mainly of glucan and xylan.

The hull residue containing the xylan may then be treated to hydrolyze at least a portion, e.g., from about 10 and preferably from about 50%, to about 100%, of the xylan to xylose. The xylan enriched hull fragments may be treated with any hydrolyzing agent sufficient to cause xylan to take up a molecule of water and forming the wood sugar xylose. Suitable hydrolyzing agents include, for example, strong inorganic acids such as sulfuric acid, hydrochloric acid, nitric acid, and mixtures thereof with relatively weak acids such as acetic acid. Dilute sulfuric acid is preferred. For example, sulfuric acid at concentrations from about 0.5 to about 10, and preferably from about 1% to about 5%, may be used. The temperature at which hydrolyzation occurs varies depending upon the hydrolyzing agent and the rate of reaction desired, but may be from about 20° C to about 200° C, more typically about 50° C to about 150° C, and when using sulfuric acid preferably from about 90° C to about 110° C.

The xylose hydrolyzate solution is then typically neutralized. For example, the xylose hydrolyzate solution may be neutralized with an alkaline earth hydroxide such as magnesium, barium, lithium or, preferably, calcium hydroxide. If desired, the hydrolyzate, which at this point may have a faint yellowish color, may then be completely decolorized by passing over activated charcoal or the like. The resulting hydrolyzate is typically a clear solution which may then be concentrated to syrup by known methods, e.g., heating under partial vacuum, for the recovery of xylose crystals.

Alternatively, the xylose hydrolyzate solution may be hydrogenated to convert xylose to xylitol. For example, the xylose hydrolyzate solution may be catalytically hydrogenated under conditions as would be evident to those skilled in this art from the present specification. For example, Raney nickel, active nickel supported on an inactive carrier, Raney copper, reduced cobalt and the like may be suitably employed. The advantage of using Raney nickel catalyst in addition to relatively low cost is that hydrogenation can be effected at relatively low temperatures and pressures. For example, conditions can involve temperatures in the range of 25° to 150° C and pressures from normal atmospheric to 150 psi. The rate of hydrogenation is of course controlled by the combined temperature and pressure along with available hydrogen concentration. Xylitol crystals may be obtained directly from the hydrogenated hydrolyzate solution by crystallizing through conventional solution concentration procedures.

The present process may be made essentially energy independent by treating part or all of the spent liquors in a wet combustion process, a standard process used in pulp mills. In this wet combustion process, the organic components (e.g., polyphenolics) of the spent liquor are burned off and the heat which results from the burning of these organic components may be fed into the system. This heat may be used, for example, to convert water into steam for use in both the pretreatment and primary treatment stages of the present process.

As indicated hereinabove, cellulosic fibers resulting from the present process comprise comparatively long fibers or linters and comparatively short fibers or hull fibers which are substantially embedded in the hull itself. Both fibers are readily washable and are substantially undegraded after treatment in the process of the present invention. By "readily washable" is meant that the fibers may easily be freed from dirt, debris, polyphenolic materials and extraneous coloring matter by contact with water or dilute alkali solution so as to be readily and easily bleached by a mild hypochloride treatment or other well-known bleaching treatment to reach a high brightness (greater than 80% G.C.). By merely contacting these fibers with water or dilute alkali solution, they may be made essentially clean. These essentially clean cellulosic fibers may be distinguished from prior art cellulosic fibers prepared according to, e.g., other chemical delinting processes.

The present process provides a more selective and complete removal of polyphenolic and extraneous coloring materials than does, e.g., soda digestion processes with the result that significantly higher carbohydrate yields are produced in accordance with the present process. Concomitantly, the effective use and consumption of alkali in the present process permits the cellulosic fibers to be more easily washed.

The cellulosic fibers produced in the present process are substantially undegraded. By "substantially undegraded" is meant that the fibers are virtually undamaged either by chemical or mechanical action so as to retain the properties of the native fibers. These substantially undegraded fibers thus differ from those produced in prior art processes such as (a) soda digestion processes wherein high base concentration tends to degrade the cellulosic fibers, or (b) certain mechanical delinting operations wherein the mechanical forces applied to the fibers tend to degrade the cellulosic fibers.

The cellulosic fibers produced according to the process of the present invention offer the following additional advantages over typical mechanical delinting processes.

(1) Higher yield of fibrous material,
(2) Recovered fibers are as clean as chemical pulp and of higher unit value, and
(3) Chemical processing eliminates the noise and respiratory dangers of certain mechanical delinting processes.

The long fibers or linters produced in the process of the present invention may be used in such applications as cotton felt, upholstery, mattress materials, and paper manufacture whereas the short fibers or hull fibers removed in accordance with the present process may be used in such applications as lacquers, rayon, cellulosic plastics and derivative, photographic film, and explosives.

Other seed hull commodities which may be recovered include xylose which is useful as a sweetener or for the production of furfural. Xylitol is also useful as a sweetener and may also be useful for its non-cariogenic properties. Moreover, the residual hull residue having the xylan extracted therefrom may then be used for livestock feed.

The present invention is further illustrated by the following examples. All parts and percentages in the examples as well as in the specification and claims are by weight unless otherwise specified.

EXAMPLE I

This example illustrates the removal of cellulosic fibers from cottonseed hulls. This example is discussed in connection with the Drawing which is a schematic diagram of a preferred embodiment of the process of the present invention.

One kilogram of cottonseed hulls with attached linters and 7.5 liters of about 0.5% by weight aqueous solution of sodium hydroxide are mixed in a 16 liter digestion vessel, heated by means of injected steam to a temperature of 90° C at atmospheric pressure for one hour (Step I). At the end of this period, the liquor (comprising dissolved polyphenolics, spent sodium hydroxide, and unused sodium hydroxide) is separated from the cellulosic fiber containing cottonseed hulls (Step II). The liquor is then subjected (Step III) to a combined wet combustion/alkali regeneration process wherein heat is produced from the wet combustion for use in preparing steam which is useful in both the primary alkali/oxygen gas treatment step as well as the pretreatment step, and alkali is regenerated for use in the subsequent primary alkali/oxygen gas treatment step.

To the solid material is then added six liters of a 2.5% by weight sodium hydroxide solution resulting in an alkali/cottonseed composition comprising 15% by weight sodium hydroxide based on the oven-dry weight of the original cottonseed hulls and 85% by weight cottonseed hulls. This mixture is heated for one hour by means of injected steam to a temperature of 120° C in the presence of 150 psi oxygen gas which is injected below the liquid level in the reactor (Step IV).

The combined materials are then passed to a blow tank (Step V) where excess pressure is relieved and heat is recovered from the vapors through a heat exchanger. Then the materials are sent to a hydrodrainer (Step VI) where the liquid material (comprising residual polyphenolics, spent sodium hydroxide and unused sodium hydroxide) is substantially removed from the cellulosic fibers. The liquid material is then recovered either with the spent liquor of the pretreatment step or separately in order to regenerate the alkali by known methods. The primary alkali/oxygen gas treatment liquor (containing some unused sodium hydroxide) is used as the pretreatment step alkali in order that the sodium hydroxide remaining after the primary alkali/oxygen gas treatment is more economically used and both the volume of fresh sodium hydroxide added to the system and the volume of spent liquor for chemical recovery and heat generation are minimized.

The solid material resulting from the draining step (VI) is then washed (Step VII) to remove any traces of dissolved hull materials which are not removed by the preceding draining step. This wash solution is combined with the spent liquor from the oxygen digestion step (Step IV) for use in the pretreatment stage, and the cellulosic fibers and hull residues are then separated according to known fiber fractionation procedures with known fiber fractionation apparatus (Step VIII).

The linters or long fibers are separated from the short hull fibers and hull residues by using a vibratory screen of suitable mesh. While long fibers are retained on the screen, the short fibers and disintegrated hull residues pass through the screen. The short fibers are then separated from the hull residues by centicleaners.

The long fibers or linters have an average length of 7 millimeters and a 6 to 10 millimeter range of length. The short or hull fibers have an average length of 2.5 millimeters and a 2 to 4 millimeter range of lengths.

EXAMPLE II

This example illustrates the removal of fibers from hull material and the production of xylan, xylose and xylitol hull commodities, as well as a residual hull animal feed.

In a series of runs, decorticated uncut cottonseed hulls, 100 parts, comprising linters attached to the hull components, were treated in a first or preliminary stage at about 100° C for about one hour with 700 parts of a 0.5% (calculated as sodium hydroxide and based on weight of solution) caustic soda solution, to remove polyphenolics and other color-forming substances. The excess liquor containing the polyphenolics and other color-forming substances was drained away and the cottonseed hulls were then treated in a second or primary stage at a temperature of about 120°-140° C for about one-half hour with 600 parts of oxygen gas-saturated, 2.5% (calculated as sodium hydroxide and based on solution weight) caustic soda solution. The caustic soda solution used in the second or primary stage treatment was then drained and thereafter used in later runs to make up the preliminary treatment liquor in the first stage. The softened and bleached cottonseed hulls and loosely attached fibers from the second stage were then washed with water.

It was found that there was a weight loss in the washed hull and fiber materials of about 40 parts from the starting cottonseed hull feed, and also that the remaining hull fraction contained xylan in a concentration higher than the original hull material (due to polyphenolic and other soluble hull components, but not appreciable xylan being extracted in the first and second stage treatments). For these runs, based on 100 parts of starting cottonseed hull material, there were about 60 parts of washed hull and fiber material containing from 25% up to 50% of xylan by weight.

Fractionation by agitated screening of the washed hull and fiber material resulted in recovery of about 20 parts cellulosic fibers and about 40 parts of separated hull fragments which contained xylan.

The xylan-containing hull fragments were then treated with hydrolyzing agent, dilute sulfuric acid, at about 100° C and atmospheric pressure to convert xylan to xylose (xylan takes up a molecule of water and forms the wood sugar xylose, a simple five-carbon sugar). Faintly yellowish xylose hydrolyzate solution from the sulfuric acid treatment was separated from the residual hull fragments, then neutralized with calcium hydroxide, and completely decolorized by passing over activated charcoal, with the insoluble calcium salts also being removed thereby. The resulting clear hydrolyzate from some of the runs was then concentrated, by heating at slightly below 100° C and under partial vacuum, to a syrup from which solid xylose was crystallized therefrom.

The clear xylose hydrolyzate solution from other of the runs was used for the production of xylitol. This was accomplished by treating the xylose hydrolyzate solution with finely divided Raney nickel catalyst and hydrogen gas at 350 psi and at a temperature of about 135°-145° C for about one hour. The reaction solution was then filtered to remove catalyst and then concentrated by heating under partial vacuum to a clear syrupy solution from which xylitol was directly crystallized in about 30% yield based on the hull fragments hydrolyzed.

The following table gives other data and results illustrating the efficacy of the process.

| Run No. | Hull Fragments (parts dry weight) | $H_2SO_4$ (parts) | Ratio of Solid Hull Fragments to Sulfuric Acid Solution | Hydrolysis Time (min.) | Xylose Recovered (parts) | Xylitol Recovered (parts) |
|---|---|---|---|---|---|---|
| 1 | 10 | 1 | 1:5 | 180 | 3.67 | 2.22 |
| 2 | 10 | 1 | 1:5 | 120 | — | 2.67 |
| 3 | 10 | 1 | 1:10 | 60 | — | 3.12 |
| 4 | 10 | 2 | 1:10 | 60 | — | 3.31 |
| 5 | 10 | 2 | 1:10 | 120 | 4.75 | 3.15 |
| 6 | 10 | 2 | 1:10 | 180 | 3.52 | 3.33 |
| 7 | 10 | 4 | 1:20 | 120 | — | 3.76 |
| 8 | 10 | 4 | 1:20 | 180 | — | 3.03 |

-continued

| Run No. | Hull Fragments (parts dry weight) | $H_2SO_4$ (parts) | Ratio of Solid Hull Fragments to Sulfuric Acid Solution | Hydrolysis Time (min.) | Xylose Recovered (parts) | Xylitol Recovered (parts) |
|---|---|---|---|---|---|---|
| 9 | 10 | 5 | 1:20 | 120 | — | 3.07 |
| 10 | 10 | 5 | 1:20 | 180 | — | 3.29 |

The residual hull fragments having the xylan extracted therefrom was a faintly yellow-colored meal suitable for livestock feed, e.g., cattle feed.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. A process for removing cellulosic fibers from uncut and once cut seed hulls having thereon linter fibers of from about 5 to about 15 millimeters in length and embedded hull fibers of from about 1.5 to about 5 millimeters in length, which comprises (a) in the absence of mechanical action sufficient to cause degradation of fiber properties, contacting at least one member selected from the group consisting of uncut and once cut seed hulls which member comprises both cellulosic fibers and non-fibrous hull components with an alkaline solution and oxygen-containing gas until the cellulosic fibers are substantially free of the non-fibrous hull components, and (b) recovering the free cellulosic fibers from the non-fibrous hull components so as to produce readily washable cellulosic fibers having substantially unimpaired mechanical properties, said cellulosic fibers comprising (i) linter fibers of from about 5 to about 15 millimeters in length and (ii) hull fibers of from about 1.5 to about 5 millimeters in length.

2. A process of claim 1 wherein cottonseed hulls are contacted with from about 2 to about 25% by weight base based upon the oven-dry weight of cottonseed hulls.

3. A process of claim 2 wherein said seed hulls are pretreated prior to step (a) with from about 0.5 to about 10% by weight base based upon the oven-dry weight of the seed hulls.

4. A process of claim 3 wherein said pretreatment is carried out in the presence of steam and the base is selected from the group consisting of hydroxides, carbonates and bicarbonates of ammonia and the alkali and alkaline earth metals.

5. A process for removing cellulosic fibers from uncut and once cut cottonseed hulls having thereon a substantial amount of linters of from about 6 to about 10 millimeters in length and embedded hull fibers of from about 2 to about 4 millimeters in length, which process comprises the sequential steps of: (a) in the absence of mechanical action sufficient to cause degradation of fiber properties, pretreating at least one member selected from the group consisting of uncut and once cut cottonseed hulls which member comprises both cellulosic fibers and non-fibrous hull components by agitating them in the presence of steam with from about 2% to about 6% by weight base in alkaline solution based upon the oven-dry weight of the seed hulls at a temperature of from about 80° to about 100° C for a period of from about 50 to about 70 minutes to remove polyphenolic materials from the cottonseed hulls and to soften the cottonseed hulls, (b) separating the softened cottonseed hulls from the alkaline solution, (c) in the absence of mechanical action sufficient to cause degradation of fiber properties, contacting the softened cottonseed hulls in the presence of steam at a temperature of from about 110° to about 130° C, and for a period of from about 45 to about 75 minutes, with an oxygen gas-saturated alkaline solution, the alkaline solution consisting essentially of water and from about 12 to about 18% by weight base selected from the group consisting of sodium hydroxide and sodium carbonate and based upon the oven-dry weight of the cottonseed hulls, with about 120 psi to 150 psi oxygen gas pressure being maintained during said contacting, (d) recovering softened cottonseed hulls and linters from the alkaline solution, (e) washing the softened cottonseed hulls and linters, and (f) fractionating the washed softened cottonseed hulls and linters so as to produce essentially clean cellulosic fibers having substantially unimpaired mechanical properties, said cellulosic fibers comprising (i) linters of from about 6 to about 10 millimeters and (ii) hull fibers of from about 2 to about 4 millimeters in length.

6. A process for obtaining xylose and readily usable cellulosic fibers from uncut and once cut seed hulls having thereon linter fibers of from about 5 to 15 millimeters in length and embedded hull fibers of from about 1.5 to about 5 millimeters in length, which process comprises: (a) in the absence of mechanical action sufficient to cause degredation of fiber properties, contacting at least one member selected from the group consisting of uncut and once cut seed hulls which member comprises both cellulosic fibers and non-fibrous hull components with an alkaline solution and oxygen gas at a concentration and temperature and for a time sufficient to remove polyphenolic materials and coloring substances but not appreciable xylan from the seed hulls and to soften the seed hulls and render fibers substantially free from the hulls and insufficient to remove appreciable xylan from the hulls; (b) separating said softened cottonseed hulls and fibers so as to produce (1) essentially clean cellulosic fibers and (2) hull residue comprising xylan, the hull residue being essentially free of polyphenolic materials and coloring substances and essentially free of hull fibers; and (c) hydrolyzing the xylan-containing hull residue to convert xylan to xylose and produce a xylose hydrolyzate solution.

7. A process according to claim 6 further comprising (d) separating the xylose hydrolyzate solution from remaining hull residue; (e) neutralizing the xylose hydrolyzate solution; (f) catalytically hydrogenating the xylose hydrolyzate solution to convert xylose to xylitol; and (g) crystallizing xylitol crystals directly from the hydrogenated hydrolyzate solution.

8. A process for obtaining xylose and readily usable cellulosic fibers from uncut and once cut cottonseed hulls having thereon linter fibers of from about 5 to 15 millimeters in length and embedded hull fibers of from about 1.5 to about 5 millimeters in length, which process comprises: (a) in the absence of mechanical action sufficient to cause degredation of fiber properties, pretreating at least one member selected from the group consisting of uncut and once cut cottonseed hulls which member comprises both cellulosic fibers and non-fibrous hull components with alkaline solution at a concentration and temperature and for a time sufficient to remove polyphenolic materials and coloring substances but not appreciable xylan from the seed hulls and to soften the seed hulls; (b) separating the softened cottonseed hulls from the alkaline solution; (c) in the absence of mechanical action sufficient to cause degredation of fiber properties, contacting the softened cottonseed hulls with an oxygen gas-saturated alkaline solution at a concentration and temperature and for a time sufficient to soften further the seed hulls and render fibers readily separable from the cottonseed hulls and insufficient to remove appreciable xylan from the hulls; (d) separating said softened cottonseed hulls and fibers so as to produce (1) essentially clean cellulosic fibers and (2) hull residue comprising xylan, the hull residue being essentially free of polyphenolic materials and coloring substances and essentially free of hull fibers; and (e) hydrolyzing the xylan-containing hull residue to convert substantially all of the xylan to xylose and produce a xylose hydrolyzate solution.

9. A process of claim 8 wherein cottonseed hulls are contacted in step (c) with from about 8% to about 20% by weight base based upon the oven-dry weight of cottonseed hulls.

10. A process of claim 8 wherein said seed hulls are contacted in step (c) at a temperature of from about 50° to about 200° C, and for a period of from about 10 to about 300 minutes.

11. A process of claim 8 wherein step (c) is carried out in the presence of steam and the alkaline solution is substantially saturated with oxygen.

12. A process of claim 8 wherein said seed hulls are pretreated in step (a) with from about 1% to about 8% by weight base based upon the oven-dry weight of the seed hulls.

13. A process of claim 12 wherein said pretreatment is carried out in the presence of steam and the base is selected from the group consisting of hydroxides, carbonates and bicarbonates of ammonia and the alkali and alkaline earth metals.

14. A process for obtaining xylose and readily usable cellulosic fibers having substantially unimpaired mechanical properties from ginned, decorticated, uncut and once cut cottonseed hulls having thereon a substantial amount of linters from about 6 to about 10 millimeters in length and embedded hull fibers of from about 2 to about 4 millimeters in length, which process comprises the sequential steps of: (a) in the absence of mechanical action sufficient to cause degredation of fiber properties, pretreating at least one member selected from the group consisting of uncut and once cut cottonseed hulls which member comprises both cellulosic fibers and non-fibrous hull components with from about 0.5% to about 10% by weight base in alkali solution based upon the oven-dry weight of the seed hulls at a temperature of from about 80° to about 100° C to remove polyphenolic materials and coloring substances from the cottonseed hulls and to soften the cottonseed hulls; (b) separating the softened cottonseed hulls from the alkaline solution; (c) in the absence of mechanical action sufficient to cause degredation of fiber properties, contacting the softened cottonseed hulls at a temperature of from about 110° to about 130° C, with an oxygen gas-saturated alkaline solution, the alkaline solution consisting esentially of water and from about 12% to about 18% by weight base selected from the group consisting of sodium hydroxide and sodium carbonate and based upon the oven-dry weight of the cottonseed hulls, to soften further the cottenseed hulls and render the linters readily separable from the hulls; (d) recovering the softened cottonseed hulls and linters from the alkaline solution of (c); (e) washing the softened cottonseed hulls and linters; (f) fractionating said softened cottonseed hulls and linters so as to separate and produce (1) essentially clean cellulosic fibers having substantially unimpaired mechanical properties, said cellulosic fibers comprising (i) linters of from about 6 to about 10 millimeters in length and (ii) hull fibers of from about 2 to about 4 millimeters in length, and (2) hull residue comprising xylan, the hull residue being essentially free of polyphenolic materials and coloring substances and essentially free of the linters and the hull fibers; (g) contacting the the xylan-containing hull residue with sulfuric acid at a temperature and concentration and for a time sufficient to convert substantially all of the xylan to xylose and produce a xylose hydrolyzate solution; (h) separating the xylose hydrolyzate solution from remaining hull residue; and (i) neutralizing the xylose hydrolyzate solution.

15. A process for obtaining multiple cottonseed hull commodities including xylitol and readily usable cellulosic fibers having substantially unimpaired mechanical properties from ginned, decorticated, uncut and once cut cottonseed hulls having thereon a substantial amount of linters from about 6 to about 10 millimeters in length and embedded hull fibers of from about 2 to about 4 millimeters in length, which process consists essentially of the sequential steps of: (a) in the absence of mechanical action sufficient to cause degradation of fiber properties, pretreating at least one member selected from the group consisting of uncut and once cut cottonseed hulls which member comprises both cellulosic fibers and non-fibrous hull components by agitating them in the presence of steam with from about 2% to about 6% by weight of alkali in alkaline solution based upon the oven-dry weight of the seed hulls at a temperature of from about 80° to about 100° C for a period of from about 50 to about 70 minutes to remove polyphenolic materials and coloring substances from the cottonseed hulls and to soften the cottonseed hulls; (b) separating the softened cottonseed hulls from the alkaline solution; (c) in the absence of mechanical action sufficient to cause degradation of fiber properties, contacting the softened cottonseed hulls in the presence of steam at a temperature of from about 110° to about 130° C, and for a period of from about 45 to 75 minutes, with an oxygen gas-saturated alkaline solution, the alkaline solution consisting essentially of water and from about 12% to 18% by weight base selected from the group consisting of sodium hydroxide and sodium carbonate and based upon the oven-dry weight of the cottonseed hulls, with about 120 psi to 150 psi oxygen gas pressure being maintained during said contacting, to soften further the cottonseed hulls and render the linters readily separable from the hulls; (d) recovering the softened cottonseed hulls and linters from the alkaline portion of (c); (e) washing the softened cottonseed hulls and linters; (f) fractionating said softened cottonseed hulls and linters so as to separate and produce (1) essentially clean cellulosic fibers having substantially unimpaired mechanical properties, said cellulosic fibers comprising (i)

linters of from about 6 to about 10 millimeters in length and (ii) hull fibers of from about 2 to about 4 millimeters in length, and (2) hull residue comprising xylan, the hull residue being essentially free of polyphenolic materials and coloring substances and essentially free of the linters and the hull fibers; (g) contacting the xylan-containing hull residue with sulfuric acid at a temperature and concentration and for a time sufficient to convert substantially all of the xylan to xylose and produce a xylose hydrolyzate solution; (h) separating the xylose hydrolyzate solution from remaining hull residue; (i) neutralizing the xylose hydrolyzate solution; (j) catalytically hydrogenating the xylose hydrolyzate solution to convert xylose to xylitol; and (k) crystallizing xylitol crystals directly from the hydrogenated hydrolyzate solution.

16. A process for removing cellulosic fibers from uncut seed hulls having thereon linter fibers of from about 5 to about 15 millimeters in length and embedded hull fibers of from about 1.5 to about 5 millimeters in length, which comprises (a) in the absence of mechanical action sufficient to cause degradation of fiber properties, contacting uncut seed hulls which comprises both cellulosic fibers and non-fibrous hull components with an alkaline solution and oxygen-containing gas until the cellulosic fibers are substantially free of the non-fibrous hull components, and (b) recovering the free cellulosic fibers from the non-fibrous hull components so as to produce readily washable cellulosic fibers having substantially unimpaired mechanical properies, said cellulosic fibers comprising (i) linter fibers of from about 5 to about 15 millimeters in length and (ii) hull fibers of from about 1.5 to about 5 millimeters in length.

* * * * *